US007798253B2

(12) United States Patent
Schuh

(10) Patent No.: US 7,798,253 B2
(45) Date of Patent: Sep. 21, 2010

(54) METHOD AND APPARATUS FOR CONTROLLING PRECESSION IN A DRILLING ASSEMBLY

(75) Inventor: Frank J. Schuh, Plano, TX (US)

(73) Assignee: Validus, Dallas, TX (US)

( * ) Notice: Subject to any disclaimer, the term of this patent is extended or adjusted under 35 U.S.C. 154(b) by 103 days.

(21) Appl. No.: 11/770,851

(22) Filed: Jun. 29, 2007

(65) Prior Publication Data

US 2009/0000826 A1 Jan. 1, 2009

(51) Int. Cl.
*E21B 17/10* (2006.01)

(52) U.S. Cl. ..... 175/325.3; 175/325.1; 175/325.2; 175/325.5; 175/76; 166/241.1; 166/241.6

(58) Field of Classification Search ..... 175/325.1, 175/325.2, 325.3, 325.5; 166/241.1, 241.6
See application file for complete search history.

(56) References Cited

U.S. PATENT DOCUMENTS 3,282,349 A * 11/1966 Cobbs et. al. ..... 166/241.6
3,572,450 A * 3/1971 Thompson ..... 175/76
3,680,647 A 8/1972 Dixon et al.
3,818,999 A 6/1974 Garrett
4,479,538 A * 10/1984 Coyle, Sr. ..... 166/173
4,635,736 A * 1/1987 Shirley ..... 175/76
4,947,944 A * 8/1990 Coltman et al. ..... 175/73
5,220,963 A * 6/1993 Patton ..... 175/24
5,273,123 A 12/1993 Bardin et al.
5,603,386 A * 2/1997 Webster ..... 175/76
5,931,239 A * 8/1999 Schuh ..... 175/61
5,941,323 A 8/1999 Warren
6,213,226 B1 4/2001 Eppink et al.
6,227,312 B1 * 5/2001 Eppink et al. ..... 175/57
6,230,557 B1 * 5/2001 Ciglenec et al. ..... 73/152.01
6,523,623 B1 * 2/2003 Schuh ..... 175/45
7,185,715 B2 3/2007 Krueger et al.
7,204,325 B2 * 4/2007 Song et al. ..... 175/61
2003/0106719 A1 * 6/2003 Herrera ..... 175/325.2
2005/0150694 A1 7/2005 Schuh
2006/0169495 A1 * 8/2006 Kolle ..... 175/61

* cited by examiner

*Primary Examiner*—Kenneth Thompson
*Assistant Examiner*—Cathleen R Hutchins
(74) *Attorney, Agent, or Firm*—Sughrue Mion, PLLC

(57) ABSTRACT

Drilling apparatuses and methods for limiting precession are provided. According to one embodiment, a drilling apparatus includes a non-rotating stabilizer. The non-rotating stabilizer includes a first blade and a second blade, the first blade being arranged opposite the second blade. The first blade is biased radially outwardly by a force of a first value. The second blade is not biased radially outwardly by a force corresponding to the first value. The second blade may be a blade which is slidable along the non-rotating stabilizer in an axial direction and allow free sliding axial contact with the formation.

29 Claims, 5 Drawing Sheets

METHOD AND APPARATUS FOR CONTROLLING PRECESSION IN A DRILLING ASSEMBLY

BACKGROUND OF THE INVENTION

1. Field of the Invention

Methods and devices consistent with the present invention relate to a structure and method of controlling precession when drilling and, more particularly, to controlling precession through the unbalanced radial biasing of blades and the use of free sliding axial blade contacts in a fixed stabilizer.

2. Description of the Related Art

In a drilling assembly for drilling for oil and the like, a "non-rotating" part may be used which does not rotate with the drill bit. For example, a non-rotating stabilizer may be used. However, although the non-rotating stabilizer does not rotate along with the drill bit, the non-rotating stabilizer may rotate due to precession because of other forces associated with drilling, such as lateral and axial forces. In at least some instances it may be advantageous to control the non-rotating stabilizer, or some other non-rotating part, so that it does not rotate due to precession. One environment in which it can be beneficial to limit the rotation of a non-rotating stabilizer is when the non-rotating stabilizer is used in a directional drilling assembly.

In related art, there are proposed methods for controlling the direction of drilling, such that the drill bit may be moved from vertical drilling to drilling in a particular direction. One method for accomplishing directional drilling is shown by U.S. Pat. No. 5,931,239 ("the '239 patent"), which is incorporated herein by reference. In the '239 patent, the direction of drilling is controlled by extending and retracting stabilizer blades in an adjustable stabilizer portion of a non-rotating stabilizer. In a non-limiting embodiment of the patent, there are four such stabilizer blades. When one of the stabilizer blades is extended and the opposite blade is retracted, the drilling assembly drills towards the retracted stabilizer blade (and away from the opposing extended stabilizer blade).

However, rotation of the non-rotating stabilizer can cause problems with the directional control. Particularly, because the adjustable blades which control the drilling direction rotate along with the non-rotating stabilizer, when the non-rotating stabilizer rotates, the shifted position of the adjustable blades changes the direction in which the blades urge the drilling assembly. For example, to turn the drilling bit of the drilling assembly in a left direction, a left blade is retracted and a right blade is extended. If the non-rotating stabilizer then rotates a half-turn (180 degrees), the position of the blades are switched. Accordingly, the originally retracted blade moves from the left side to the right side and the originally extended blade moves from the right side to the left side. In this manner, rotation of the non-rotating stabilizer moves the blades to a position of turning the drilling assembly to the right rather than the left. It is thus difficult to control drilling to proceed in a particular direction when the non-rotating stabilizer rotates due to precession.

The drilling apparatus can be programmed to adjust the blades as the non-rotating stabilizer turns in order to counteract the rotation. However, if the non-rotating stabilizer turns too quickly, adjustments to the blades cannot keep pace with the rotation. Furthermore, controlling the direction of the drilling is easier if the non-rotating stabilizer turns slower or not at all.

Accordingly, it would be advantageous to be able to limit the precession of a non-rotating part such as a stabilizer.

SUMMARY OF THE INVENTION

The present invention provides apparatuses and methods for controlling precession.

According to an aspect of the present invention, there is provided a drilling apparatus including: a non-rotating stabilizer; the non-rotating stabilizer including a first blade and a second blade, the first blade being arranged opposite the second blade; wherein the first blade is biased radially outwardly by a force of a first value; and wherein the second blade is not biased radially outwardly by a force corresponding to the first value.

The second blade may be biased radially outwardly by a force which is lower than the first value.

The second blade may be biased radially outwardly by substantially no force.

The force of the first value biasing the first blade may be provided by a spring.

The non-rotating stabilizer may include a fixed stabilizer and an adjustable stabilizer and the first blade and the second blade may be part of the fixed stabilizer.

The adjustable stabilizer may comprise a plurality of adjustable stabilizer blades which are extendable.

The second blade may be slidably attached to the non-rotating stabilizer in an axial direction of the non-rotating stabilizer.

The second blade may be slidably attached such that the second blade can move at least 0.3 inches in the axial direction.

The second blade may be slidably attached such that the second blade can move at least 0.5 inches in the axial direction.

According to another aspect of the present invention, there is provided a drilling apparatus comprising a non-rotating stabilizer comprising a fixed stabilizer; wherein the fixed stabilizer comprises a plurality of blades; wherein at least one of the plurality of blades of the fixed stabilizer is biased radially outwardly by a force different than another one of the plurality of blades.

Another one of the plurality of blades may be biased radially outwardly by substantially no force.

The plurality of blades may comprise four blades circumferentially arranged around the non-rotating stabilizer.

The plurality of blades may comprise five blades circumferentially arranged around the non-rotating stabilizer.

The plurality of blades may comprise six blades circumferentially arranged around the non-rotating stabilizer.

According to another aspect of the present invention, there is provided a drilling apparatus comprising: a non-rotating stabilizer comprising a fixed stabilizer; wherein the fixed stabilizer comprises a plurality of blades; wherein at least one of the plurality of blades of the fixed stabilizer is slidable along the non-rotating stabilizer in an axial direction of the non-rotating stabilizer.

At least one of the plurality of blades may be slidable at least 0.1 inches in the axial direction.

At least one of the plurality of blades may be slidable at least 0.3 inches in the axial direction.

At least one of the plurality of blades may be slidable at least 0.5 inches in the axial direction.

The non-rotating stabilizer further may comprise an adjustable stabilizer, the adjustable stabilizer comprising a plurality of adjustable blades which are extendable and retractable.

According to another aspect of the present invention, there is provided a drilling apparatus comprising: a non-rotating stabilizer comprising a first blade, a second blade, a third blade and a fourth blade arranged around the circumference of the non-rotating stabilizer; wherein the first and second blades are spring loaded by springs of a first spring constant; and wherein the third blade is opposite the first blade and the fourth blade is opposite the second blade and the third blade and the fourth blade are not spring loaded.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE EXEMPLARY EMBODIMENTS

Figure 1:
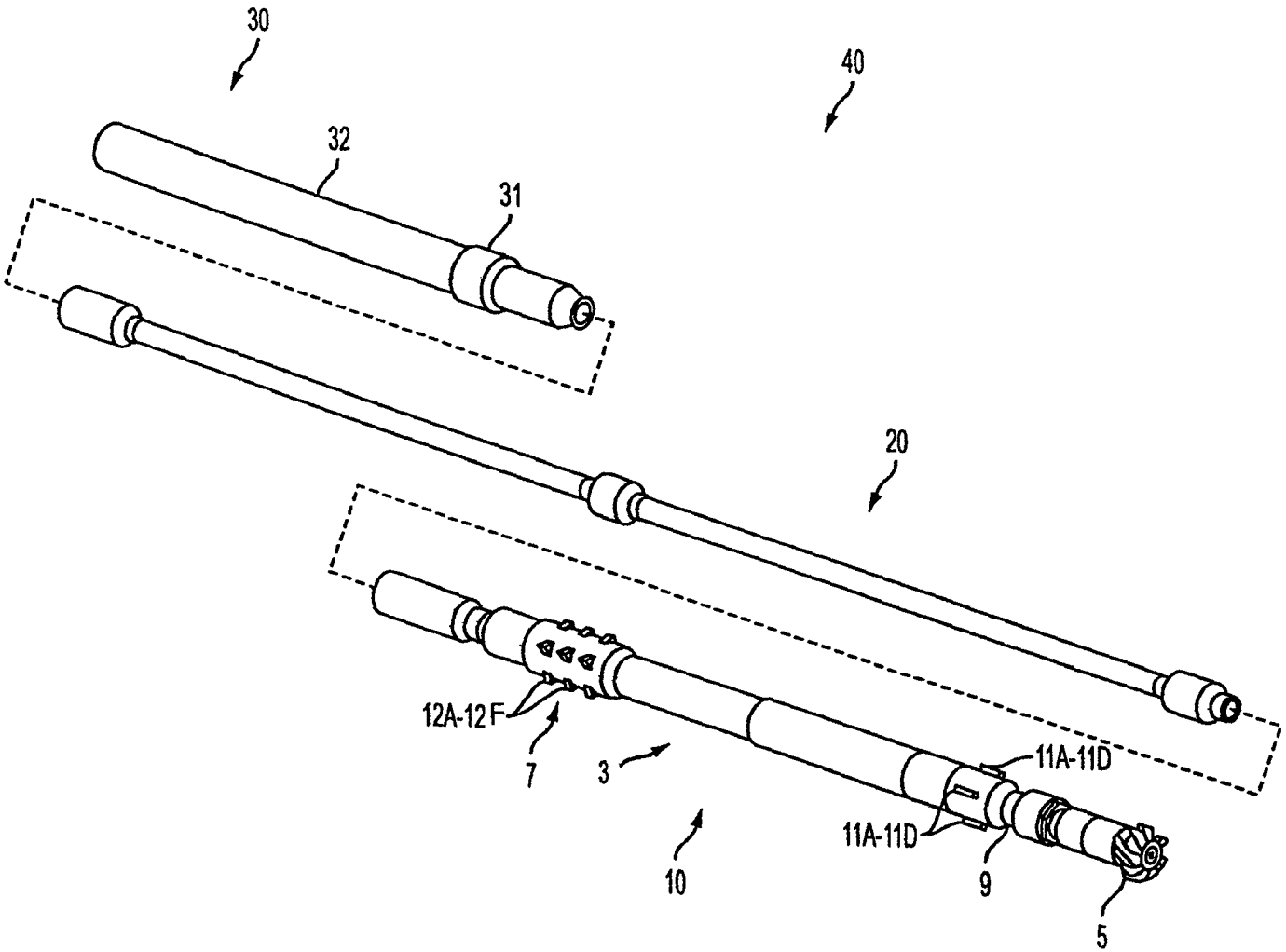
FIG. 1 illustrates an exemplary embodiment of a drilling assembly.

Exemplary embodiments of the invention will now be described below with reference to the attached drawings. The described exemplary embodiments are intended to assist the understanding of the invention, and are not intended to limit the scope of the invention in any way. In the following description, the same drawing reference numerals are used for the same elements throughout.

FIG. 1 shows an assembly for a directionally controlled drilling system 40. The drilling system 40 includes a communications link 30, a non-rotating stabilizer 10 and a flex joint 20 which joins the communications link 30 and the non-rotating stabilizer. The communications link includes an antenna portion 32 and a spiral stabilizer 31. It is connected to one end of the flex joint 20. The drilling system 40 also includes a drill bit 5 at an end thereof. The drill bit 5 is rotatably driven to dig a bore hole in the ground. This can be done through a motor, not shown.

The non-rotating stabilizer 10 is attached to the opposite end of the flex joint 20 and includes a fixed stabilizer 7, an adjustable stabilizer 9 and an antenna portion 3 there between. The non-rotating stabilizer 10 does not rotate with the drill bit 5. However, the non-rotating stabilizer 10 may rotate if acted upon by other forces.

The adjustable stabilizer 9 may be of the type described in U.S. Pat. No. 5,931,239. In this exemplary embodiment the adjustable stabilizer includes four adjustable blades 11A-11D. Each of the blades may extend or retract to control the direction of drilling. As described above and in the '239 patent, when one of the blades 11A-11D is extended, the drill bit 5 is urged away from the extended blade. Conversely, the drill bit 5 is urged towards a retracted blade. Accordingly, extension and retraction of the various adjustable blades 11A-11D allows for the drilling system 40 to be steered.

The non-rotating stabilizer 10 also includes a fixed stabilizer 7. The fixed stabilizer 7 is connected to the adjustable stabilizer 9 through the antenna portion 3. In the exemplary embodiment shown in FIG. 1, the fixed stabilizer 7 includes four blades 12A-12F. Four blades allows for an even number and a symmetrical arrangement. However, the number of blades is not limited to four. Fewer or more than four blades could be used, for example, two, three, five or six or more blades could be used.

The inventors of the present application discovered that a drilling assembly with a non-rotating stabilizer operated in two modes, a "smooth mode" and a "vibrating mode".

Smooth Mode Precession

Figure 2:
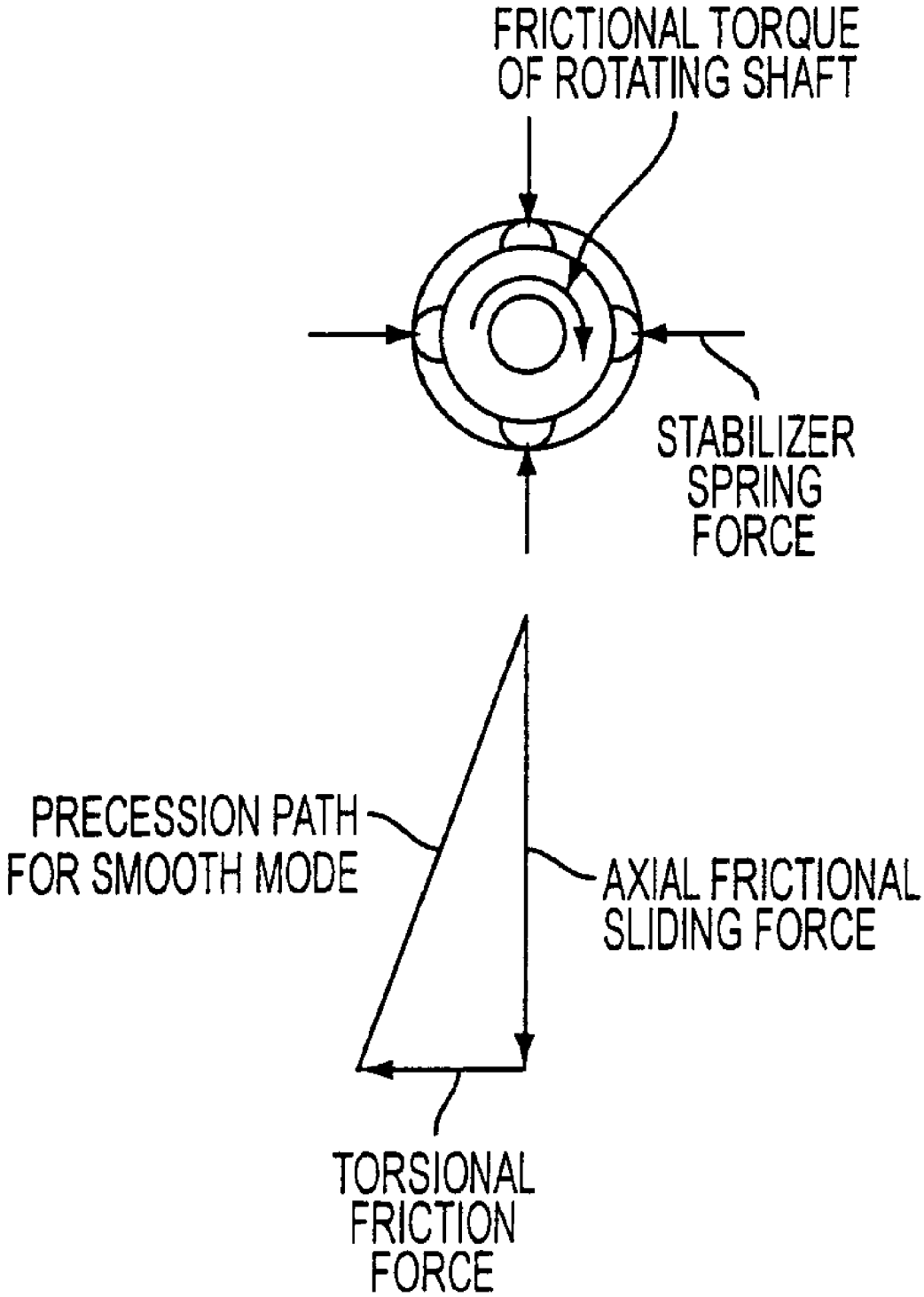
FIG. 2 illustrates precession mechanics in a "smooth mode"

In the "smooth mode", the precession rate follows the mechanics of an axial sliding frictional contact that is subjected to a clockwise torsional input. This is shown in FIG. 2. In an experiment, a first example of a drilling system each of the blades of the fixed stabilizer were biased radially outwardly with similar spring loads. As the bit drills downward in FIG. 2, the friction between the fixed blades and the formation generated an axial sliding force. The fixed stabilizer also receives a torsional force generated by the friction between the rotating drilling shaft and the non-rotating stabilizer unit. This is depicted as the lateral torsional friction force in FIG. 2. The dotted line that connects these two vectors describes the precessional path of a fixed stabilizer contact. In this mode, the precession rate can be calculated from the contact force and its axial sliding friction factor and the applied clockwise torque. For a 4 bladed stabilizer:

$$PRS = \left(\frac{12 \cdot 360}{pi \cdot D}\right)\left(\frac{2 \cdot T}{D \cdot 4 \cdot f \cdot FS}\right). \qquad \text{Eq 1}$$

| | |
|---|---|
| $PRS$ = Precession Rate for Smooth Mode, | deg/ft drilled |
| $D$ = Diameter of hole, | inch |
| $T$ = Frictional torque between rotating shaft and non-rotating stabilizer, | in lb |
| $f$ = Sliding friction factor between stabilizer contact and formation | * |
| $f$ = .35 for water base drilling fluid | |
| $FS$ = Spring force on a fixed stabilizer contact | lbs |

With this mode, the designer can select the contact force that provides acceptable precession rates for the expected frictional torque and sliding friction factor. For 500 lb springs, a 0.35 friction coefficient, and 120 in lb torsional friction in a 8.5 in. hole, the smooth precession rate would be 6.5 degrees per ft of hole.

Vibrating Mode Precession

In the "vibrating mode" the observed precession rates were many times greater than were calculated or observed in the smooth mode. In this test, the inventors collected enough precession data to enable them to calculate the sliding friction factor as a function of depth if they assumed that the smooth mode mechanics also applied to the vibrating mode. While in the smooth mode the calculated friction factors were typically in the 0.25 to 0.5 range, which is reasonably close to an expected value of about 0.35 for drill string friction in a water base mud environment. The inventors also observed occasional values as high as 0.6 and 0.8, which they attribute to the microscopic variations in the rock surface.

However, while in the vibrating mode the calculated friction factors were quite close to zero. This calculated friction factor of zero does not make sense in the drilling environment. Such an environment would clearly produce a friction factor significantly greater than zero. Thus, the inventors concluded that some other mode of operation must have controlled the precession mechanics during this time. The inventors most likely explanation for the periods of excessive precession is that the bottom hole assembly must have been severely vibrating during these periods.

Many of the service companies that supply Measurement While Drilling (MWD) tools report that downhole acceleration measurements frequently exceed 20 g (g-force), or more. Drilling assemblies experience axial, lateral, and torsion vibrations, sometimes all at the same time. Non-rotating units should not be affected by torsional vibrations. However, axial and lateral vibrations can greatly increase the precession rates of a non-rotating stabilizer. The most disruptive vibrations are axial and lateral vibrations that occur at one of the resonant frequencies of the drilling assembly.

Figure 3:
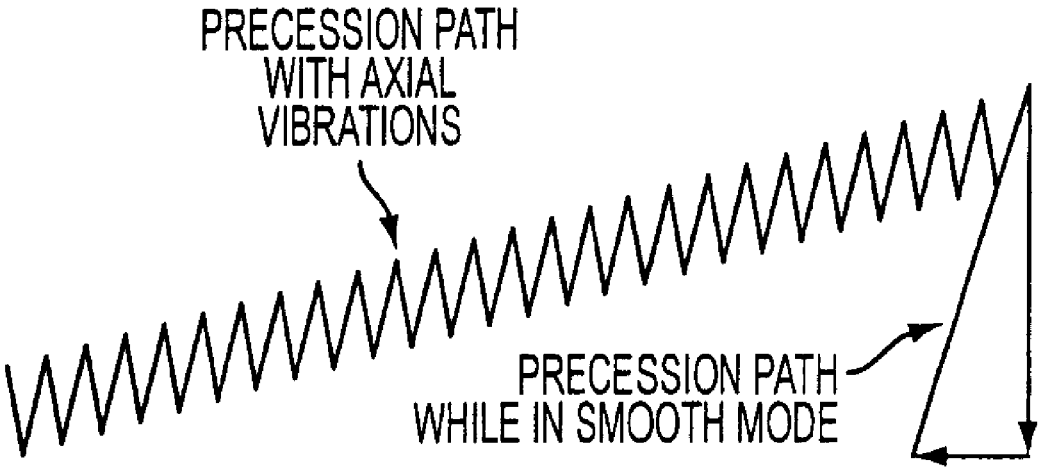
FIG. 3 illustrates precession mechanics in a "vibrating mode"

The inventors believe that axial vibration affects the precession mechanics by greatly increasing the distance that the lateral stabilizer contact must move. FIG. 3 shows how axial motions can greatly increase the distance traveled and the resulting precession rate. The increased axial motion alters the smooth mode precession equation for a 4 bladed stabilizer as follows:

$$PRA = \left(\frac{360\cdot(12+3\cdot RPM\cdot 2\cdot AMP\cdot 60/ROP)}{pi\cdot D}\right)\cdot\left(\frac{2\cdot T}{D\cdot 4\cdot f\cdot FS}\right) \quad \text{Eq. 2}$$

| | |
|---|---|
| $PRA$ = Precession Rate for Axial Vibrations in the Vibrating Mode | deg/ft drilled |
| $RPM$ = Rotary Speed with Tri-cone bit | rev/min |
| $AMP$ = Amplitude of axial vibrations | inch |
| $ROP$ = Drilling rate | ft/hr |
| $D$ = Diameter of hole, | inch |
| $T$ = Frictional torque between rotating shaft and non-rotating stabilizer | in lbs |
| $f$ = Sliding friction factor between stabilizer contact and formation | * |
| $f$ = .35 for water base drilling fluid | |
| $FS$ = Spring force on a fixed stabilizer contact | lbs |

If the tool described in the smooth example had an axial vibration amplitude of 0.2 inch while drilling at 30 ft/hr with a rotary speed of 80 revs/min the precession rate would increase to 110 degrees per ft drilled.

Lateral vibrations can have a similar effect on precession. The spring loaded stabilizers must have a minimum diameter that is smaller than the bit and a maximum extension that is larger than bit diameter. In the inventors first experimental drilling tool they used radial dimensions of a 1/16 in under gauge minimum and a 1/8 in. over gauge maximum. With equal springs in each blade the inventors created a design that allowed the tool to be deflected laterally with very low loads. If the rotary speed matched a resonant frequency in the bottom hole assembly the lateral vibrations could begin with very low oscillating loads. The oscillations and deflection energy would both build because they matched a resonant frequency. The first tool would move 1/8 in. laterally as it alternately fully compressed the springs on opposite sides of the tool. The continuous frictional torque that is applied to the tool causes the lateral motion of the tool to rotate it rather than hold a steady orientation. FIG. 4 illustrates how the frictional torque creates this rotation.

Figure 4A:
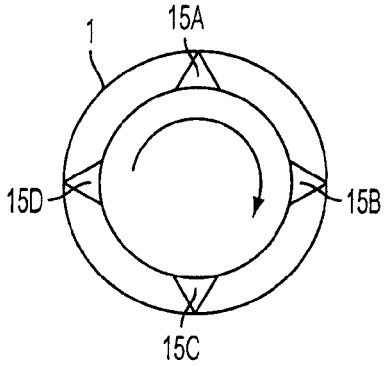
FIG. 4 is an explanatory illustration of clockwise precession induced by lateral vibration and torque.
Figure 4B:
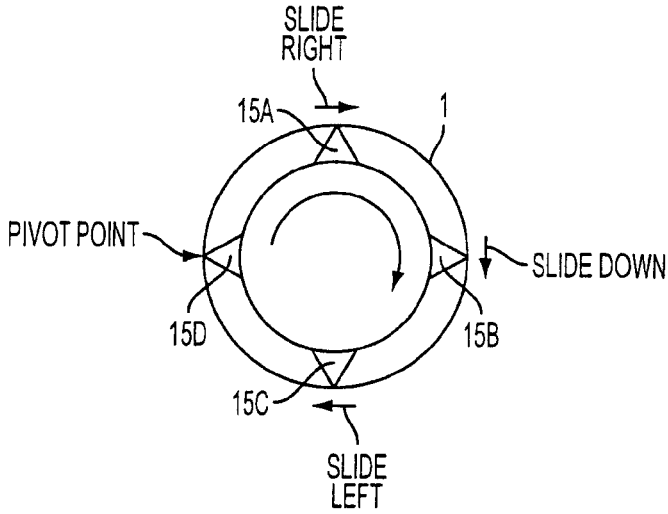
Figure 4C:
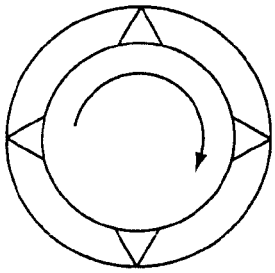
Figure 4D:
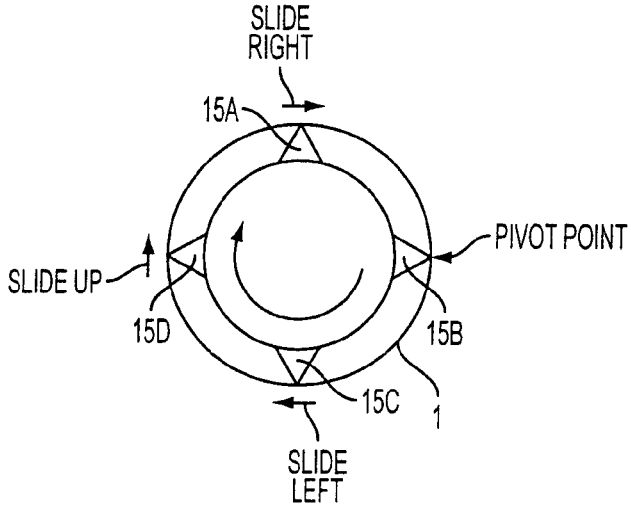

FIGS. 4A-4D shows four stabilizer blades 15A-15D in a borehole 1. The stabilizer blades that are not aligned with the lateral oscillations would have to move in opposite directions if the tool kept the same orientation. One blade would move clockwise and the other would have to move counter clockwise. Because of the clockwise frictional torque it is much easier to turn a blade clockwise than counter clockwise. This causes the counter clockwise blade to stay fixed in the hole and become a pivot point that allows the other stabilizers on the tool to rotate clockwise about the pivot point. With reference to the location of the blades in the figures, FIG. 4A shows the upper blade 15A being compressed and the lower blade 15C being extended. In this situation, the left blade 15D acts as a pivot point so that the upper blade 15A slides to the right, the right side blade 15B slides down and the bottom blade 15C slides to the left. As shown in FIGS. 14C and 14D, when the upper blade 15A is fully extended, the right side blade 15B acts as a pivot point and the remaining blades 15A, 15C and 15D rotate clockwise. With each side to side movement the tool rotates 1/8 in. circumferentially. This increases the precession rate as indicated by the following:

$$PRL = \left(\frac{360\cdot(12+CPM\cdot 2\cdot AMP\cdot 60/ROP)}{pi\cdot D}\right)\cdot\left(\frac{2\cdot T}{D\cdot 4\cdot f\cdot FS}\right) \quad \text{Eq. 3}$$

| | |
|---|---|
| $PPL$ = Precession Rate for Lateral Vibrations in Vibrating Mode | deg/ft drilled |
| $CPM$ = Vibration frequency | cycles/min |
| $AMP$ = Amplitude of lateral vibrations | inch |
| $ROP$ = Drilling rate | ft/hr |
| $D$ = Diameter of hole, | inch |
| $T$ = Frictional torque between rotating shaft and non-rotating stabilizer | in lbs |
| $f$ = Sliding friction factor between stabilizer contact and formation | * |
| $f$ = .35 for water base drilling fluid | |
| $FS$ = Spring force on a fixed stabilizer contact | lbs |

If the same frequency is experienced here as in the axial case, then 1/8 in. lateral vibrations would generate a precession rate of 71 deg/ft drilled.

In view of the above, the present inventors discovered that vibrations in the axial direction (in the up and down direction of the borehole) and vibrations in the lateral direction (causing the stabilizer to move from side to side in the borehole) cause rotation of the stabilizer. Accordingly, the present inventors recognized that if axial and lateral vibrations could be reduced, the rate of precession (rotation) could be reduced and the directional drilling could be better controlled.

In the experiments above, each of the blades of the fixed stabilizer is biased by a substantially equal spring force. When each of the blades are biased by a similar force, it is not difficult to induce movement of the fixed stabilizer in the bore hole. For example, consider a fixed stabilizer with four blades with each blade being biased by a spring force of 500 lbs. In order for the fixed stabilizer to be moved to the left, the spring biasing the left blade would have to be compressed. Generally, in order to compress the left spring a force of greater than 500 lbs would be necessary. However, in the situation described above, the spring biasing the right blade provides a force tending to compress the spring biasing the left blade. Indeed, since the spring forces biasing each of the blades are similar, a much smaller force than 500 lbs is necessary to compress the spring biasing the left blade. Indeed, generally a 550 pound load would be required to compress a 500 lb spring $1/16^{th}$ of an inch and 460 pounds to relax it 1/16 of an inch. However, when there are opposing blades each biased by 500 lb springs, the force required to oscillate the tool by a 1/32 of an inch in any direction is only 45 pounds and only 90 pounds is required to move the blade 1/16 of an inch. Regardless of the number of blades, when opposite blades are biased by a similar spring force small forces can cause compression of the springs and movement of the blades. In turn, this can cause precession. This provides an ideal condition for building high energy resonant vibrations because they can begin with extremely low energy deflections that can build because of resonance. Accordingly, lateral vibrations of the stabilizer contacts are maximized through the use of spring-loaded stabilizer blades.

In order to limit precession caused by lateral vibration, the drilling system according to an exemplary embodiment of the present invention includes a fixed stabilizer which avoids symmetrical radial biasing of the blades of the fixed stabilizer. Particularly, according to the exemplary embodiment, opposite blades in the fixed stabilizer 7 are not biased by a similar spring force.

Figure 5:
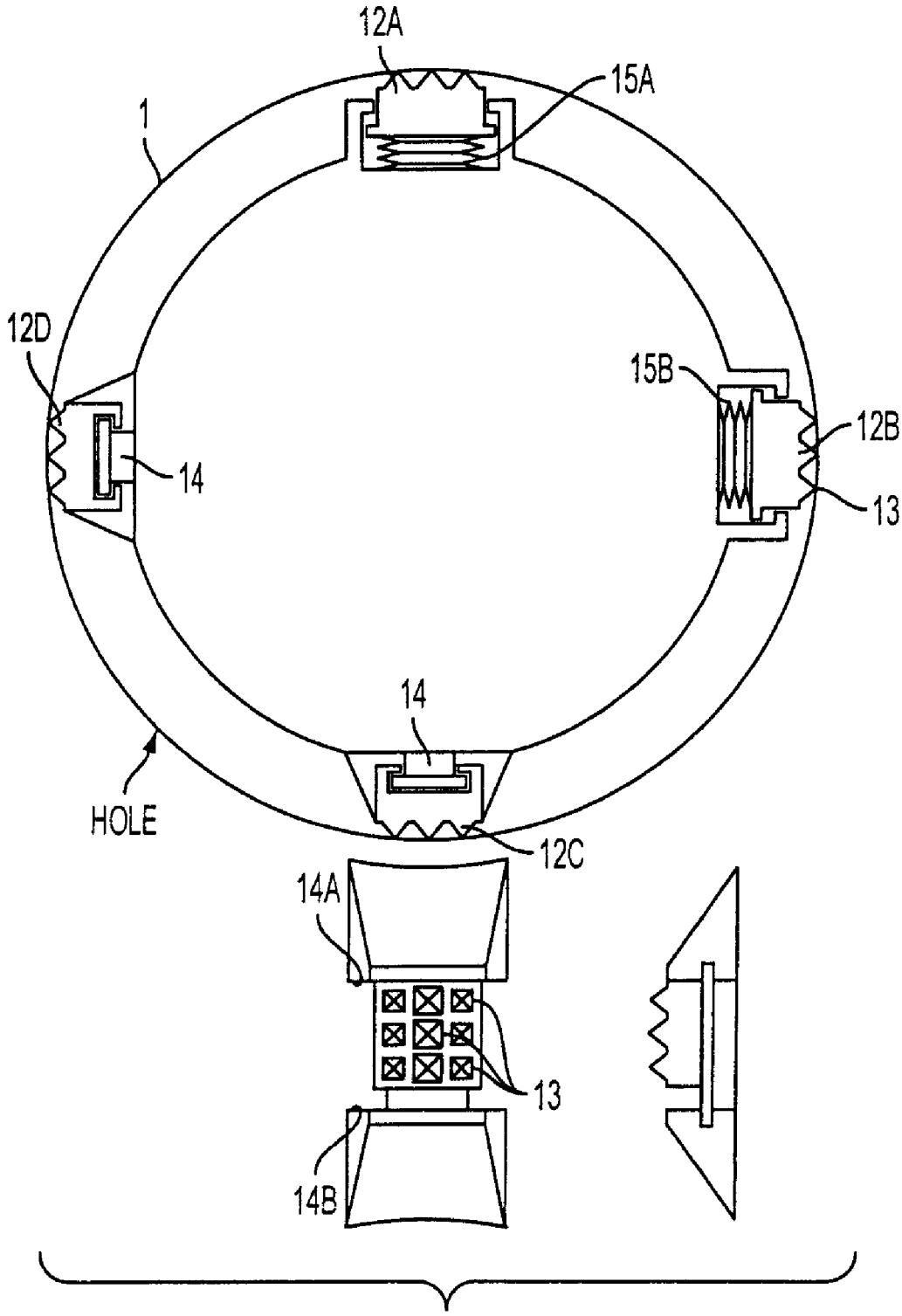
FIG. 5 illustrates an exemplary embodiment of the blades of a fixed stabilizer.

An exemplary embodiment of the blades 12A-12D of a fixed stabilizer according the present invention is shown in FIG. 5. In the exemplary embodiment, the top blade 12A and the right blade 12B are each biased in the radial direction by respective biasing spring 15A, 15B. However, the blades opposite the top blade 12A and the right blade 12B are not biased by springs. Particularly, a bottom blade 12C opposite the top blade 12A is not radially biased by a spring. Likewise, the left blade 12D, opposite the right blade 12B is not radially biased by a spring.

With springs in only two of the blades, the tool can only move laterally, in one direction. If the lateral load is directed at the fixed blades 12C, 12D which are not spring loaded, no motion is possible, regardless of the size or load. These blades 12C, 12D are simply fixed in the lateral/radial direction. When the motion is directed towards the spring-loaded blades 12A, 12B, it will require a lateral force of more than 500 pounds to get any motion. It will take 550 pounds to move 1/16th of an inch. By making the threshold for the initial motion high enough, the development of resonant vibrations is prevented. Thus, in the exemplary embodiment of the present invention without an equal opposing spring force, 550 pounds is required to move 1/16th of an inch. In the example described above with opposing spring forces, only 90 pounds load is required for a movement of $1/16^{th}$ of an inch. Accordingly, the exemplary embodiment suppresses lateral motion and vibration.

The present exemplary embodiment can accommodate more than one spring biasing each biased blade 12A, 12B. For example, there may be three 500 lb springs biasing each blade. This would create a 1500 lb minimum threshold for the lateral force that is required to initiate vibrations. The values and the number of springs is not particularly limited. However, providing more numerous or rigid springs provide a higher barrier to lateral movement. A biasing spring force on a single blade of at least 250 lbs may be used to create a high barrier to lateral movement and a biasing force of at least 500 lbs may be used to ensure that a sufficiently high barrier is created.

Although this exemplary embodiment includes four blades, the number of blades of the fixed stabilizer is not particularly limited and there may be more or less than four blades. For example, there may be six blades in which three adjacent blades being biased by a spring force and the opposing three blades not being biased by a spring force. Alternatively, there may be five blades with two or three adjacent blades being biased by a spring force and the remaining two or three blades being biased by no spring force or a substantially lower spring force.

Furthermore, the exemplary embodiment includes two blades 12A, 12B which are biased by a spring force and two blades 12C, 12D which are not biased by a spring force. The blades 12C, 12D may also be biased in the radial direction by a spring force which is significantly lower than the blades 12A, 12B, particularly a spring force which substantially different enough so as to limit axial movement. For example, they may be biased by a spring force that is at least 100 lbs lower than the spring force of the blades 12A, 12B. In order to raise the barrier to lateral movement, they may also be biased by a spring force that is at least 250 lbs lower or 500 lbs lower than the spring biasing blades 12A, 12B.

The fixed stabilizer 7 of the exemplary embodiment is also designed to control precession caused by axial vibrations. The precession caused by axial vibrations is the result of the significant up and down motion. In order to address the precession caused by this axial direction, the exemplary embodiment mounts two of the blades 12C, 12D on free sliding axial supports 14. During normal downward drilling, the free sliding blades will ride on the top end 14A of the free sliding support, as shown in FIG. 5. This is due to the friction acting on the free sliding blades 12C, 12D as they move downwardly. The friction will oppose the downward motion and keep the free sliding blades at the top end of their sliding position. On the other hand, if the non-rotating stabilizer begins bouncing up and down, the blades will remain in stationary contact with the hole 1 whenever the tool bounces upward. That is, because of the frictional contact between the blades 12C, 12D and the hole 1, the blades tend to remain in the same place. Thus, when the bottom end of the drilling assembly bounces upwardly, the non-rotating stabilizer is able to move upwardly relative to the sliding blades 12C, 12D as the sliding blades 12C, 12D remain in the same position. The sliding blades slide relatively downwardly towards the bottom of the free sliding support 14B.

On the other hand, when the tool bounces downward, the top end of the free sliding support 14A contacts the blades 12C, 12D to move them in the downward direction with the rest of the non-rotating stabilizer. This allows the bottom end of the drilling assembly to bounce up and down while the blades 12C, 12D only move downward. This limits the total distance moved by the free sliding blades 12C, 12D to the downward advance of the drill bit and limits the precession rate of the non-rotating assembly to that predicted for the smooth mode. The coefficient of friction between the blades 12C, 12D and the free sliding support 14 is much lower than the coefficient of friction between the blades 12C, 12D and the hole 1. This assures free sliding of the blades 12C, 12D rather than movement between the blades 12C, 12D and the hole 1.

If the free sliding length exceeds the amplitude of the axial vibrations of the bottom end of the drilling assembly, there is only downward motion of the free sliding of the blades 12C, 12D. The exemplary embodiment shows a free sliding length of the blades 12C, 12D of 0.5 in. Axial vibrations are estimated to be in the range of 0.1 to 0.3 in. Accordingly, a free sliding length is of at least 0.1 in limits the blades to downward motion in at least some instances. A free sliding length of at least 0.3 in should provide enough sliding length in most conditions. A free sliding length of at least 0.5 in. may be used to more certainly provide a sufficient free sliding length.

As noted above, the friction between the blades 12C, 12D and the borehole 1 wall is greater than the friction between the blade and the free sliding support so that the blades 12C, 12D are held by the borehole wall and move along the free sliding rail. The free sliding blade contacts may provide formation friction factors that are at least three times as high as the pad to rail friction factors. Furthermore, the sliding surface of the sliding support upon which the blades slide may be equipped with diamond bearings to significantly increase the friction ratio. Contact portions of the sliding support and the pads may be manufactured from tungsten carbide to enhance life.

In the exemplary embodiment of FIG. 5, each of the blades 12A-12D includes a number of pyramid shaped spikes 13. This shape helps to increase the friction between the blades 12A-12D and the borehole 1. Using 45° sloped pyramids avoids generating bending loads on the contacts. The tops of the pyramid shaped spikes may be flattened to ensure the required lateral load capacity and to increase wear resistance. Also, in the exemplary embodiment of FIG. 5, the spikes 13 are arranged in three rows of three. The three rows of the exemplary embodiment are designed to provide equal contacts in a gauge hole surface. The rows are also separated to promote self cleaning of the spikes 13.

Although the present invention has been described in connection with the exemplary embodiments of the present invention, it will be apparent to those skilled in the art that various modifications and changes may be made thereto without departing from the scope and spirit of the invention. Therefore, it should be understood that the above embodiments are not limitative, but illustrative in all aspects.

What is claimed is:

1. A drilling apparatus comprising:

a non-rotating stabilizer;

the non-rotating stabilizer including a first blade and a second blade, the first blade being arranged opposite the second blade;

wherein the first blade is biased radially outwardly by a force of a first value;

wherein the second blade is not biased radially outwardly by a force corresponding to the first value;

wherein the second blade slidably attached to the non-rotating stabilizer in an axial direction of the non-rotating stabilizer, and wherein the first blade is a non-steering blade.

2. The drilling apparatus according to claim 1, wherein the second blade is substantially unbiased.

3. The drilling apparatus according to claim 1, wherein the force of the first value biasing the first blade is provided by a spring.

4. The drilling apparatus according to claim 1, wherein the non-rotating stabilizer includes a fixed stabilizer and an adjustable stabilizer and the first blade and the second blade are part of the fixed stabilizer.

5. The drilling apparatus according to claim 4, wherein the adjustable stabilizer comprises a plurality of adjustable stabilizer blades which are extendable.

6. The drilling apparatus according to claim 1, wherein the second blade is slidably attached such that the second blade can move at least 0.3 inches in the axial direction.

7. The drilling apparatus according to claim 1, wherein the second blade is slidably attached such that the second blade can move at least 0.5 inches in the axial direction.

8. The drilling apparatus according to claim 1, wherein the first blade and the second blade are identical in shape and size.

9. The drilling apparatus according to claim 1, wherein the force of the first value biases the entire first blade.

10. The drilling apparatus according to claim 1, wherein each of the first blade and the second blade comprises a plurality of pyramid shaped spikes.

11. The drilling apparatus according to claim 1, wherein the non-rotating stabilizer does not rotate with a drill bit.

12. A drilling apparatus comprising:

a non-rotating stabilizer comprising a fixed stabilizer that controls precession and an adjustable stabilizer that controls direction of drilling;

wherein the fixed stabilizer comprises a plurality of blades;

wherein at least one of the plurality of blades of the fixed stabilizer is biased radially outwardly by a force different than another one of the plurality of blades; and wherein one of the plurality of blades is slidably attached to the non-rotating stabilizer in an axial direction of the non-rotating stabilizer.

13. The drilling apparatus according to claim 12, wherein the another one of the plurality of blades is substantially unbiased.

14. The drilling apparatus according to claim 12, wherein the plurality of blades comprises four blades circumferentially arranged around the non-rotating stabilizer.

15. The drilling apparatus according to claim 12, wherein the plurality of blades comprises five blades circumferentially arranged around the non-rotating stabilizer.

16. The drilling apparatus according to claim 12, wherein the plurality of blades comprises six blades circumferentially arranged around the non-rotating stabilizer.

17. A drilling apparatus comprising:

a non-rotating stabilizer unit comprising a fixed stabilizer that is freely slidable and that controls precession and an adjustable stabilizer that controls direction of drilling;

wherein the fixed stabilizer comprises a plurality of blades;

wherein at least one of the plurality of blades of the fixed stabilizer is slidable along the non-rotating stabilizer unit in an axial direction of the non-rotating stabilizer unit.

18. The drilling apparatus according to claim 17, wherein the at least one of the plurality of blades is slidable at least 0.1 inches in the axial direction.

19. The drilling apparatus according to claim 17, wherein the at least one of the plurality of blades is slidable at least 0.3 inches in the axial direction.

20. The drilling apparatus according to claim 17, wherein at least one of the plurality of blades is slidable at least 0.5 inches in the axial direction.

21. The drilling apparatus according to claim 17, wherein the non-rotating stabilizer unit further comprises an adjustable stabilizer, the adjustable stabilizer comprising a plurality of adjustable blades which are extendable and retractable.

22. A drilling apparatus to minimize precession comprising:

a non-rotating stabilizer unit comprising a first blade, a second blade, a third blade and a fourth blade arranged around the circumference of the non-rotating stabilizer unit;

wherein the first and second blades are spring loaded by springs of a first spring constant;

wherein the third blade is opposite the first blade and the fourth blade is opposite the second blade and the third blade and the fourth blade are not spring loaded; and wherein the first and second blades are non-steering blades.

23. The drilling apparatus according to claim 22, wherein the first and second blades are loaded by springs of approximately 500 lbs of spring force.

24. A drilling apparatus comprising:

a non-rotating stabilizer;

the non-rotating stabilizer including a first blade and a second blade, the first blade being arranged opposite the second blade;

wherein the first blade is biased radially outwardly by a force of a first value;

wherein the second blade is not biased radially outwardly by a force corresponding to the first value;

wherein the second blade is slidably attached to the non-rotating stabilizer and the first blade is not slidably attached to the non-rotating stabilizer; and wherein the first blade is a non-steering blade.

25. The drilling apparatus according to claim 24, wherein the second blade is slidably attached to the non-rotating stabilizer such that the second blade moves between 0.3 inches to 0.5 inches in the axial direction.

26. A drilling apparatus comprising:

a non-rotating stabilizer;

the non-rotating stabilizer including a first blade and a second blade, the first blade being arranged opposite the second blade;

wherein the first blade is directly biased radially outwardly by a force of a first value exerted by an element dedicated to the first blade;

wherein the second blade is not biased radially outwardly by a force corresponding to the first value; and wherein only one of the first blade and the second blade is mounted on a sliding axial support.

27. The drilling apparatus according to claim 26, the element is a dedicated spring directly biasing the first blade.

28. The drilling apparatus according to claim 27, wherein increasing load on the first blade, recompresses the element.

29. The drilling apparatus according to claim 26, wherein the slidable blade is mounted in the free sliding support that moves the slidable blade only in a downward direction with the non-rotating stabilizer.

* * * * *